US009791249B2

(12) United States Patent
Geisler et al.

(10) Patent No.: US 9,791,249 B2
(45) **Date of Patent: *Oct. 17, 2017**

(54) KINETIC FIREBALL INCENDIARY MUNITION

(71) Applicant: Exquadrum, Inc., Adelanto, CA (US)

(72) Inventors: Robert L Geisler, Tehachapi, CA (US); Kevin E Mahaffy, Oak Hills, CA (US)

(73) Assignee: Exquadrum, Inc., Adelanto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/828,918

(22) Filed: Aug. 18, 2015

(65) Prior Publication Data

US 2016/0054108 A1 Feb. 25, 2016

Related U.S. Application Data

(60) Division of application No. 13/929,313, filed on Jun. 27, 2013, now Pat. No. 9,423,224, which is a continuation of application No. 12/748,795, filed on Mar. 29, 2010, now Pat. No. 8,495,959, which is a continuation-in-part of application No. 11/804,412, filed on May 18, 2007, now abandoned, which is a division of application No. 11/434,045, filed on May 15, 2006, now Pat. No. 7,278,356.

(51) Int. Cl.

| | |
|---|---|
| ***F42B 12/44*** | (2006.01) |
| ***F42B 12/58*** | (2006.01) |
| ***F42B 12/52*** | (2006.01) |

(52) U.S. Cl.

CPC ..... *F42B 12/44* (2013.01); *F42B 12/52* (2013.01); *F42B 12/58* (2013.01)

(58) Field of Classification Search

CPC ..... F42B 12/36; F42B 12/44; F42B 12/46; F42B 12/52; F42B 12/56; F42B 12/58

USPC ..... 102/364, 365

See application file for complete search history.

(56) References Cited

U.S. PATENT DOCUMENTS

| | | | | |
|---|---|---|---|---|
| 2,558,726 A | | 7/1951 | Barker | |
| 3,054,349 A | | 9/1962 | Plumley | |
| 3,149,567 A | | 9/1964 | Buck | |
| 3,269,313 A | * | 8/1966 | Willmann | F42B 12/50 102/368 |
| 3,291,050 A | | 12/1966 | Ahlert et al. | |
| 3,498,218 A | | 3/1970 | Myers | |
| 3,611,931 A | | 10/1971 | Bessey et al. | |
| 3,736,878 A | | 6/1973 | Guntermann | |
| 3,865,035 A | | 2/1975 | Munson et al. | |
| 3,905,297 A | | 9/1975 | Barr et al. | |

(Continued)

FOREIGN PATENT DOCUMENTS

| | | | | |
|---|---|---|---|---|
| GB | 591129 A | * | 8/1937 | F42B 12/44 |

*Primary Examiner* — James S Bergin

(74) *Attorney, Agent, or Firm* — Hamre, Schumann, Mueller & Larson, P.C.

(57) ABSTRACT

A kinetic fireball incendiary munition is provided having an outer shell or bomb casing, one or more incendiary sub munitions therein, and an igniter therefore. Each of the submunitions includes an incendiary portion, at least one rocket motor that propels the submunition inside of a target volume, and an oxidizer for the incendiary portion and rocket motor. The submunitions liberate sufficient heat to produce elevated temperatures inside of a target structure to thermalize the contents thereof without creating a substantial overpressure or explosive effect.

19 Claims, 13 Drawing Sheets

(56) References Cited

U.S. PATENT DOCUMENTS

| | | | | |
|---|---|---|---|---|
| 3,937,070 | A | 2/1976 | Briar | |
| 3,951,068 | A | 4/1976 | Schroeder | |
| 3,961,576 | A | 6/1976 | Montgomery, Jr. | |
| 3,961,579 | A | 6/1976 | Faber et al. | |
| 4,173,931 | A | 11/1979 | Schiessl et al. | |
| 4,216,721 | A | 8/1980 | Marziano et al. | |
| 4,318,343 | A | 3/1982 | King | |
| 5,698,812 | A | 12/1997 | Song | |
| 6,540,175 | B1 | 4/2003 | Mayersak et al. | |
| 6,766,744 | B1 | 7/2004 | Song et al. | |
| 6,945,175 | B1 * | 9/2005 | Gotzmer | F42B 12/44 102/364 |
| 7,278,356 | B1 | 10/2007 | Geisler et al. | |
| 7,568,432 | B1 * | 8/2009 | Baker | C06B 33/06 102/364 |
| 8,118,955 | B2 | 2/2012 | Zavitsanos et al. | |
| 8,495,959 | B2 | 7/2013 | Geisler et al. | |
| 8,505,427 | B2 | 8/2013 | Wilson et al. | |
| 9,423,224 | B2 * | 8/2016 | Geisler | F42B 12/44 |
| 2011/0011296 | A1 | 1/2011 | Diewald | |

* cited by examiner

KINETIC FIREBALL INCENDIARY MUNITION

REFERENCE TO RELATED APPLICATIONS

This is a divisional of U.S. patent application Ser. No. 13/929,313, filed Jun. 27, 2013, now U.S. Pat. No. 9,423,224, which is a continuation of U.S. patent application Ser. No. 12/748,795, filed Mar. 29, 2010, now U.S. Pat. No. 8,495,959, which is a continuation-in-part of U.S. patent application Ser. No. 11/804,412, filed May. 18, 2007, now abandoned, which is a divisional of U.S. patent application Ser. No. 11/434,045, filed May 15, 2006, now U.S. Pat. No. 7,278,356.

FIELD OF THE INVENTION

The present invention relates in general to incendiary munitions and, more particularly, to an incendiary munition capable of thermalizing the interior of targets, such as bunkers, buildings, gun emplacements, storage facilities, etc. to a high enough temperature to neutralize chemical and biological agents. Further, a disc-shaped incendiary submunition is provided having one or more barrels embedded in the incendiary material which contains a powder charge and projectile(s) which can be fired radially outwardly to damage any stored containers of chemical/biological materials.

BACKGROUND OF THE INVENTION

Modern warfare has been evolving in the direction of the use of precision-guided weapons to kill targets such as buildings and storage facilities used by terrorists in the midst of areas occupied by civilian communities. This places a premium on weapons that minimize collateral damage while efficiently destroying the occupants and/or contents of these structures. These requirements call for the development of a new class of weapon.

A conventional delivery system used to effect sequential air bursts of sub-munitions is disclosed in U.S. Pat. No. 3,611,931 to Bessey, et al. One of the sub-munitions disclosed by Bessey, et al. is a rocket-type munition consisting of a conventional starter powder to be ignited by a powder column, a conventional propellant composition and a nozzle to emit a hot gas stream which can propel the sub-munition. The payload disclosed by Bessey, et al. can be either an explosive or an incendiary composition. However, there is no disclosure in Bessey, et al. of an incendiary composition which can penetrate a structure and once inside can release sufficient heat to thermalize the environment to a high enough temperature to neutralize chemical and biological agents inside the target structure.

Of high interest is that the trends in recent world events have made it clear that armed forces will increasingly face hostile forces, such as terrorist groups, armed with nuclear, biological and/or chemical (NBC) weapons. These terrorist groups operate from a variety of types of facilities, from light skinned metal buildings to hardened, underground structures, to support these weapons. These facilities are used for research and development, manufacturing, production, and storage of these weapons.

Advanced munitions are being developed to penetrate and defeat this range of facility targets. However, novel payloads for these munitions are also required to confidently defeat these facilities without releasing and dispersing the very biological and chemical weapons sought to be destroyed. At present, no conventional munitions achieve such object.

In particular, payloads of incendiary munitions capable of raising internal facility room temperatures uniformly to well over 1,000° F. in a non-explosive manner for an extended period of time are needed to neutralize biological and chemical weapons contained in munitions and other storage vessels, and to minimize collateral effects. A number of approaches have been taken to solve this problem, including the use of high explosive munitions containing white phosphorous, conventional rockets released inside a target structure, thermobaric weapons, shells, and other explosives. However, it is ideal that the incendiary or other weapon used in these missions does not explode, and force these dangerous materials into the surrounding environment.

Another problem is that these conventional approaches fail to raise the temperature of the target volume to a high temperature for an extended period of time. In order to neutralize and/or destroy such chemical and biological weapons, the target volume temperature must be raised to a high temperature for an extended period of time. Instead, conventional approaches employ high explosives with phosphorous, which generally raise the temperature of the target volume to high temperatures, but for only a fraction of a second and, in the process, cause an undesirable overpressure, which may destroy the vessels containing the materials and the structure resulting in the spread harmful materials into collateral regions, or into the atmosphere in an unintended and undesirable way.

For example, phosphorous-based munitions used for such applications generally blow the roof off of the target structure, allowing the heat and gas to escape. Moreover, these conventional approaches also fail to transfer the necessary high heat uniformly through multi-rooms, halls, and large target volumes containing the materials to be destroyed.

Another example of a conventional incendiary munition is illustrated in U.S. Pat. No. 4,318,343 to King which combines the effects of a jetting incendiary with a slow burning incendiary. The main purpose of the incendiary bomblet of King is to start fires within a target structure. The purpose of the jetting incendiary in King is to ensure that the burning incendiary is adjacent to a flammable item which can catch fire. The jet of hot gases from the bomblet are used to propel the munition to a position adjacent to a flammable item. Since the purpose of the incendiary munition of King is to ignite items in a target structure, it would be necessary that an air/oxygen supply be available in the target structure because there is no disclosure in King of providing an oxygen source for combustion.

One of the problems with this conventional type of incendiary munition is that it does not burn for a sufficient time to raise the overall temperature in a target room to temperatures sufficient to neutralize chemical and biological agents. One possible reason for the short burn time is that oxygen in a target room is quickly consumed once an incendiary mixture is ignited. Another possible reason is that the incendiary munition of King does not contain an oxidizer for the fuel which would ensure that the fuel would continue to burn until all of the fuel is consumed.

It is therefore an object of the present invention to provide an incendiary munition capable of liberating sufficient heat to elevate temperatures inside of a structure to over 1,000° F. for an extended period of time, such as in four or five minutes or more, without creating any substantial overpressure, or having an explosive effect on the target structure.

It is another object of the present invention to provide a highly effective incendiary munition for neutralizing chemical and/or biological agents inside target structures, without forcing these dangerous substances to vent into the surrounding environment.

It is still another object of the present invention to provide an incendiary munition which can raise internal facility room temperatures to well over 1,000° F. in a non-explosive manner and continue to liberate heat after oxygen in a target structure is exhausted, so as to neutralize biological and chemical weapons therein with a minimum of collateral damage.

It is a further object of the present invention to provide an incendiary munition which contains self-propelled sub-munitions capable of causing the ignited sub-munition to move around the room to more uniformly distribute hot gases generated by the incendiary material contained within the submunition throughout the target structure being attacked.

It is yet another object of the present invention to provide an incendiary munition capable of rapidly moving a thermal source through a maximum amount of the target volume, so as to rapidly distribute liberated heat by stirring the gases in the target volume to more equally heat the entire volume of the target, thus destroying the internal contents of the target volume thermally, without violent explosion or detonation.

It is another object of the present invention to provide an incendiary munition which contains both a fuel and an oxidizer which, therefore, has a combined ability to destroy targets by kinetic impact and extreme temperatures, without a violent explosion or detonation, and which can burn even in the absence of air/oxygen.

It is a further object of the present invention to provide an incendiary munition utilizing an obduration fluid to withstand extremely high acceleration forces (g forces) on impact and penetration of hardened structures and earth.

It is another object of the present invention to provide an incendiary submunition capable of frictionless movement and self-rotation through the use of energetic material and geometry, without the need for the utilization of other mechanical or electrical mechanisms.

It is a further object of the present invention to provide an incendiary submunition in which thrust from the submunition itself can be programmed or timed to prevent the submunition from being trapped in corners within the target volume during use, while also moving and accelerating the submunition randomly within the target volume during application.

It is yet another object of the present invention to provide a disc-shaped incendiary submunition in which one or more barrels embedded in the incendiary material contains a powder charge and projectile(s) which can be fired radially outwardly to damage any stored containers of chemical/biological materials.

SUMMARY OF THE INVENTION

It was unexpectedly discovered by the present inventors that the above-described objects could be achieved with the incendiary munition of the present invention, which is capable of thermalizing the interior of a target structure or bunker without creating any substantial overpressure or detonation. In particular:

In a first preferred embodiment there is provided an incendiary munition for thermalizing an interior volume of a target structure, said incendiary munition having an outer shell or bomb casing, one or more incendiary submunitions inside of said shell or bomb casing, and an igniter therefor, the improvement comprising:

a submunition which comprises an incendiary portion and one or more rocket motors which fire when the incendiary portion ignites, said rocket motor being capable of propelling the submunition inside a target structure, said submunition containing an internal oxidizer for the incendiary portion and the rocket motor, thereby facilitating ignition and heating from both the burning outer surfaces of the submunition as well as from the rocket motor, whereby the incendiary portion and rocket motor together liberate sufficient heat to produce elevated temperatures inside of the target structure to thermalize the interior of the target structure without creating a substantial overpressure or explosive effect.

In a second preferred embodiment there is provided in the first preferred embodiment an incendiary munition, wherein the submunition is formed at least in part from an incendiary portion comprising a mixture of solid propellant/oxidizer.

In a third preferred embodiment there is provided in the second preferred embodiment an incendiary munition, wherein the solid propellant further contains one or more energetic materials selected from the group consisting of phosphorous, boron, magnesium, aluminum, perfluorocarbon liquid-aluminum and $BKNO_3$.

In a fourth preferred embodiment there is provided in the first preferred embodiment an incendiary munition, wherein at least a part of the incendiary portion forms an outer exposed surface of the submunition.

In a fifth preferred embodiment there is provided in the first preferred embodiment an incendiary munition, wherein a nozzle in the rocket motor is positioned to discharge propellant gases outwardly from the submunition, thereby propelling the submunition within the target structure.

In a sixth preferred embodiment there is provided in the first preferred embodiment an incendiary munition, wherein the rocket motor comprises a solid propellant/oxidizer therefor together with a rocket nozzle.

In a seventh preferred embodiment there is provided in the sixth preferred embodiment an incendiary munition, wherein the rocket motor is formed integral with the incendiary portion of the submunition.

In an eighth preferred embodiment there is provided in the sixth preferred embodiment an incendiary munition, wherein the rocket motor is formed inside of the submunition by forming a cavity inside of a propellant/oxidizer in an inner portion of the submunition.

In a ninth preferred embodiment there is provided in the eighth preferred embodiment an incendiary munition, wherein a hole in the propellant extending from said cavity to an outer surface of the submunition defines a rocket nozzle.

In a tenth preferred embodiment there is provided in the ninth preferred embodiment an incendiary munition, wherein the hole defining a rocket nozzle is lined with a non-flammable material.

In an eleventh preferred embodiment there is provided in the first preferred embodiment an incendiary munition, wherein the submunition is substantially spherically shaped, with one or more integrally formed rocket motors inside of the spherical submunition.

In a twelfth preferred embodiment there is provided in the first preferred embodiment an incendiary munition, wherein the submunition is generally disk-shaped, with one or more integrally formed rocket motors inside of the disk-shaped submunition.

In a thirteenth preferred embodiment there is provided in the twelfth preferred embodiment an incendiary munition, wherein the disk-shaped submunition contains at least two integrally formed rocket motors, each of said rocket motors having one or more nozzles pointed in different directions.

In a fourteenth preferred embodiment there is provided in the thirteenth preferred embodiment an incendiary munition, wherein a first and second rocket motor fire sequentially.

In a fifteenth preferred embodiment there is provided an incendiary submunition for thermalizing an interior volume of a target structure, comprising:

an incendiary portion;

one or more rocket motors inside the incendiary portion which fire upon or after the ignition of the incendiary portion, and which are capable of propelling the submunition inside of the target structure;

said submunition containing an oxidizer for both the incendiary portion and for the rocket motor, thereby facilitating the liberation of heat from both a burning outer surface of the submunition and from the rocket nozzle;

whereby the incendiary portion and rocket motor liberate sufficient heat to produce elevated temperatures inside of the target structure to thermalize the interior of the target structure without creating a substantial overpressure or explosive effect during combustion.

In a sixteenth preferred embodiment there is provided in a fifteenth preferred embodiment an incendiary submunition, wherein the incendiary portion is formed at least in part from a solid propellant optionally containing an energetic material selected from the group consisting of phosphorous, boron, magnesium, aluminum, and fluorocarbon liquid-aluminum and $BKNO_3$, and the outer surface of the submunition comprises solid propellant.

In a seventeenth preferred embodiment there is provided in the fifteenth preferred embodiment an incendiary submunition, wherein the rocket motor is defined by a cavity formed in the solid propellant comprising the incendiary portion of the submunition, with a hole extending from the cavity to an outer surface of the submunition so as to define a rocket nozzle.

In an eighteenth preferred embodiment there is provided in the fifteenth preferred embodiment an incendiary submunition, wherein the rocket motor is disposed within the incendiary portion of the submunition.

In a nineteenth preferred embodiment there is provided in the fifteenth embodiment an incendiary submunition, wherein the submunition is in the shape of a sphere, with a rocket motor formed inside of the sphere.

In a twentieth preferred embodiment there is provided in the fifteenth preferred embodiment an incendiary submunition, wherein the submunition is in the form of a circular disk with one or more rocket motors formed inside of the disk, each rocket motor having a separate nozzle extending from an inside cavity of the rocket motor to an outer surface of the disk, whereby to propel the disk when the rocket motor is fired.

In a twenty-first preferred embodiment there is provided in the fifteenth preferred embodiment an incendiary submunition, wherein an insulation layer is bonded to an outer surface of the disk-shaped propellant, and a portion of the insulation layer on the top and bottom of the disk is weakened so as to blow out when top and bottom surfaces of the propellant are ignited, thereby liberating heat from the rocket motor and from both the top and bottom surfaces of the burning disk.

In a twenty-second preferred embodiment there is provided in the twenty-first preferred embodiment an incendiary submunition, wherein the insulation layer is composed of any of a variety insulating materials, such as EPDM rubber (ethylene propylene diene monomer) or HTPB (hydroxy terminated polybutadiene) filled with silica ($SiO_2$) particles. Analysis and experimental results demonstrated that a properly designed interface between the insulation layer and the incendiary propellant allows the bulk of the propellant to act as a heat sink thus allowing the submunition to survive for longer periods of time in the high temperature environment without increasing the thickness of the insulation layer. This is important because the submunition has greatest effectiveness when the ratio of incendiary propellant mass to inert mass is at its greatest.

In a twenty-third preferred embodiment there is provided in the twenty-first preferred embodiment an incendiary submunition, wherein igniters positioned in both a top and bottom surface of the disk ignite propellant and blow off portions of the insulation on the top and bottom surfaces of the disk.

In a twenty-fourth preferred embodiment there is provided in the twenty-first preferred embodiment an incendiary submunition, wherein a plurality of said incendiary submunitions are sequentially ignited inside of a target structure, whereby to raise the temperature therein to as high as 1700° F. for about five minutes.

In a twenty-fifth preferred embodiment there is provided an incendiary submunition for thermalizing an interior volume of a target structure and for damaging any containers for chemical/biological materials, comprising an incendiary portion, and oxidizer for the incendiary portion contained in the incendiary portion, one or more barrels embedded in the incendiary portion, said barrels containing a powder charge and projectile(s), whereby the incendiary portion liberates sufficient heat to produce elevated temperatures inside a target structure without creating a substantial overpressure or explosive effect during combustion, and said powder charge when detonated propels said projectile(s) radially outwardly to damage any containers of chemicals/biological materials.

In a twenty-sixth preferred embodiment there is provided in the twenty-fifth preferred embodiment an incendiary submunition which is disc-shaped and has an outer insulation layer thereon.

In a twenty-seventh preferred embodiment there is provided in the twenty-fifth embodiment an incendiary submunition in which the barrels point radially outwardly and upwardly.

DETAILED DESCRIPTION OF THE INVENTION

The present invention provides an incendiary munition comprised of an outer shell or bomb casing, one or more incendiary submunitions therein, and an igniter therefore. The incendiary submunition comprises an incendiary portion, and at least one rocket motor that fires when the incendiary portion ignites. It was unexpectedly discovered that, during operation, the combustion of the surface of the incendiary portion comprised of solid propellant creates a gas cushion that results in the levitation of the incendiary submunition above the ground.

While being levitated by the combustion of the outer surface of the incendiary submunition, the rocket motor disposed within the submunition ignites and propels the submunition and the incendiary portion violently around within the target structure. The combustion of the surface of the incendiary submunition, along with the firing of the rocket motor therein, liberates sufficient heat to produce elevated temperatures inside of a target structure without creating a substantial overpressure or explosive effect.

Figure 1:
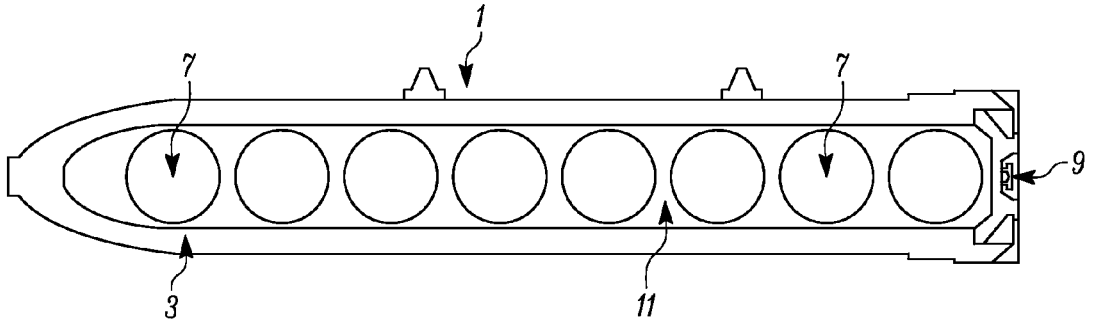
FIG. 1 is a cross-sectional view of an incendiary munition, illustrating the use of spherically shaped submunitions spaced apart and surrounded by an obduration liquid according to the present invention.

For example, as shown in FIG. 1, an incendiary munition of the present invention comprises an outer shell or bomb casing 3, a plurality of submunitions 7 carried inside of the casing 3, a fuse 9 carried in an end of casing 3, and an obduration liquid 11 inside of casing 3 and surrounding submunition 7. The casing 3 is designed to penetrate a wall or bunker wall without destruction of the submunitions 7, which are released from casing 3 after the munition 1 has entered an interior target volume.

Figure 2:
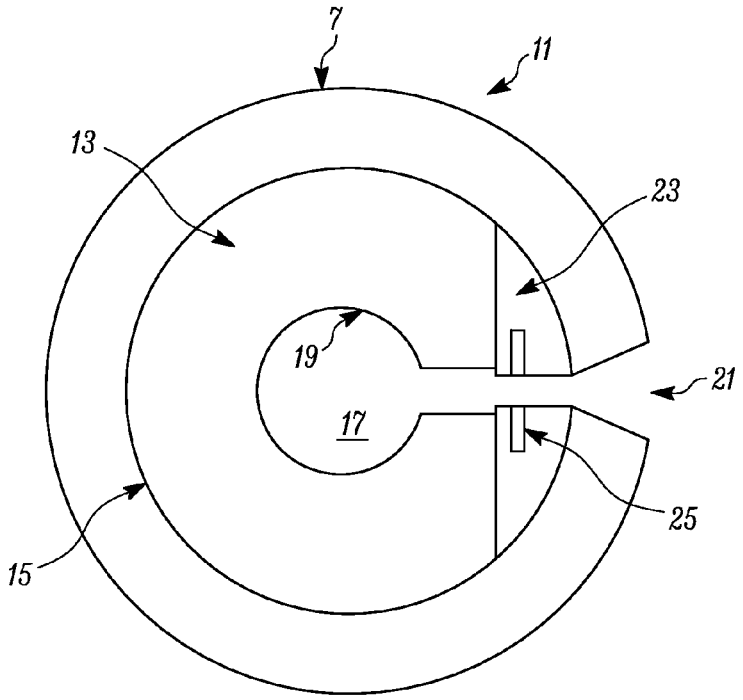
FIG. 2 is a cross-sectional view of one of the submunitions used in the incendiary munition of FIG. 1, illustrating the inner and outer propellant, spherical steel case, and integrally formed rocket motor and nozzle.

In a preferred embodiment, the submunition 7 is in the form of a sphere, as shown in FIGS. 1 and 2. As illustrated in FIG. 2, the spherical shaped submunition is comprised of an outer propellant layer 11, an inner propellant 13, a steel case 15, and a rocket motor shown generally at 17. The rocket motor 17 is comprised of a propellant chamber wall 19 and passage 21 defining a rocket nozzle, through which propellant combustion gases from rocket motor 17 escape to the atmosphere.

In the preferred embodiment described above, as shown in FIG. 2, nozzle liner 23 is constructed of a non-incendiary material, so as to minimize erosion of the nozzle wall during firing of rocket motor 17. The preferred embodiment shown in FIG. 2 further illustrates the use of a phenolic plate 25 in the mouth of rocket motor 17 so as to minimize burning of the nozzle 21. In the preferred embodiment shown in FIG. 2, the submunition 7 is approximate 12 inches in diameter, but may be made in any size according to the target to be attacked.

In a preferred embodiment, the incendiary submunition described above is formed at least in part from an incendiary portion, said incendiary portion comprising a solid propellant which, optionally, contains one or more energetic materials selected from the group consisting of phosphorous, boron, magnesium, aluminum, liquid fluorocarbon-aluminum and $BKNO_3$. In another preferred embodiment, at least a part of the incendiary portion forms an outer surface of the submunition, and a nozzle in the rocket motor is oriented to outwardly discharge propellant gases from the rocket motor to propel the submunition within a target volume. The rocket motor preferably uses a solid propellant as fuel to propel the submunition. Generally, the rocket motor contains the same solid propellant used to form the incendiary portion of the submunition, but any suitable propellant may be used in the rocket motor. The rocket motor is preferably integrally formed in the incendiary portion of the submunition.

Figure 8:
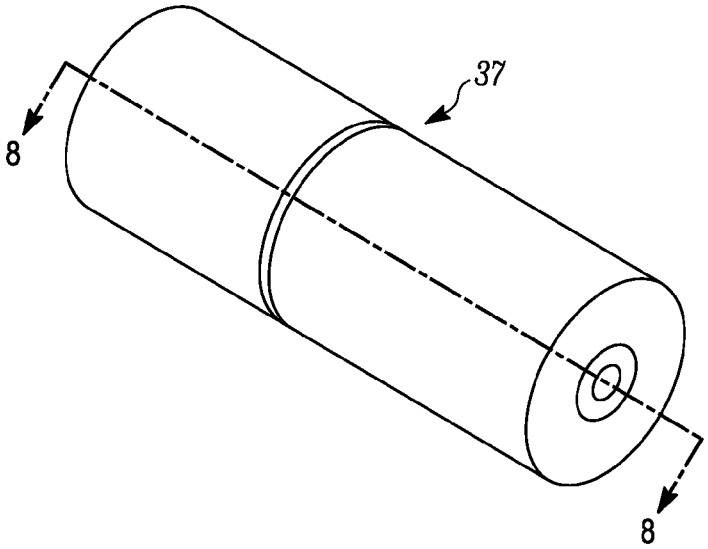
FIG. 8 is a perspective view of a rocket motor, which can be embodied in a submunition of the present invention.
Figure 9:
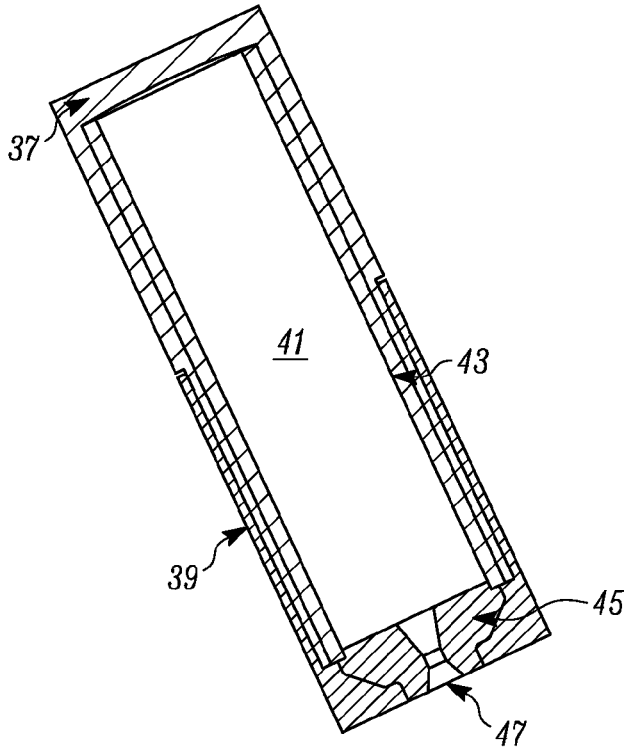
FIG. 9 is a cross-sectional view taken along line B-B of FIG. 8, showing a rocket motor, which can be embedded in the submunition of the present invention of FIGS. 1 and 2.

In another preferred embodiment, the rocket motor described above is formed inside of the incendiary submunition by forming a cavity inside of the solid propellant in an inner portion of the submunition, and a hole in the propellant extends from the cavity to an outside surface of the submunition so as to define a rocket nozzle. Thus, the cavity within the solid propellant may define the rocket motor. Alternatively, a rocket motor as shown generally at 37, as illustrated in FIG. 8, can be embedded in the submunition of the present invention. A cross-sectional view of rocket motor 37 taken along line B-B of FIG. 8 is illustrated in FIG. 9. As shown therein, rocket motor 37 comprises an outer case 39, propellant 41, inner insulator 43, graphite nozzle 45, and igniter 47.

Figure 3:
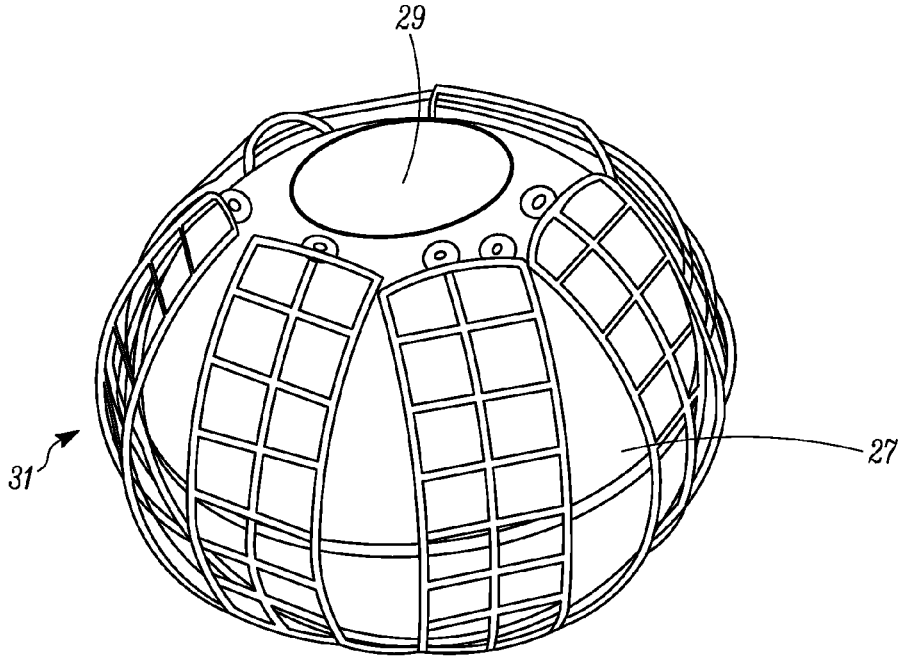
FIG. 3 is a photograph of a spherical metal case of the submunition of FIGS. 1 and 2, illustrating an inner and outer case, and modifying reinforcing wires to be embedded inside of a solid propellant layer on the outside of the submunition.
Figure 4:
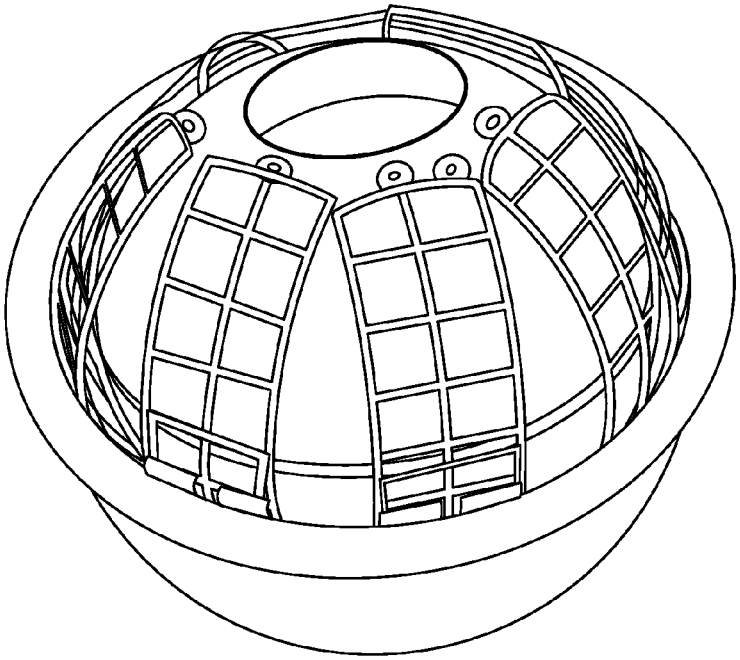
FIG. 4 is a photograph of the spherical metal case of FIG. 3, showing the additions of propellant inside of the case, and the application of propellant to the outside reinforcing wires.
Figure 5:
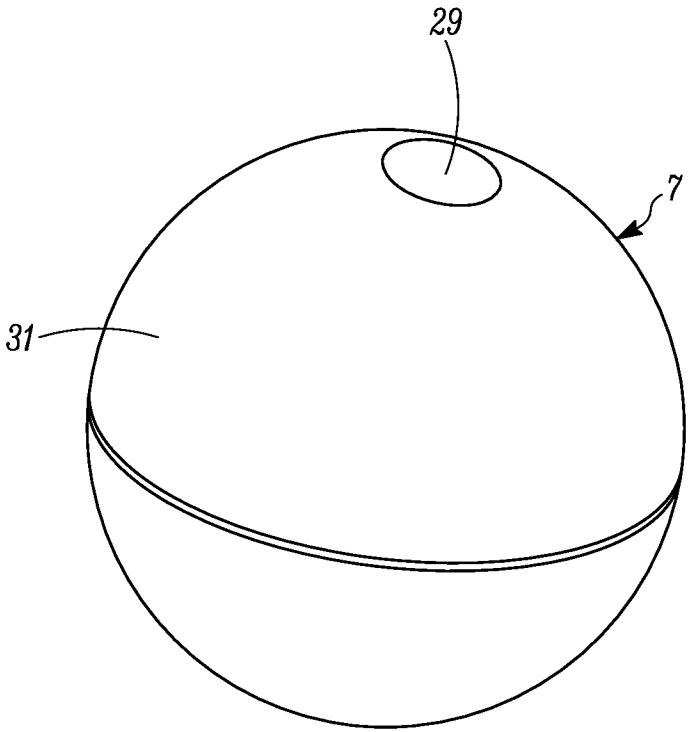
FIG. 5 is a photograph of the spherical submunition of FIGS. 3 and 4, showing the outer surface with propellant completely covering the reinforcement, and the discharge nozzle for an internally situated rocket motor.

In another preferred embodiment, the incendiary submunition is spherically shaped with an integrally formed rocket motor inside of the sphere. One preferred method of construction of the submunition 7 shown in FIGS. 1 and 2 is illustrated in FIGS. 3-5. In particular, the photograph of FIG. 3 illustrates a hollow spherical steel case 27, open at the top 29 and having reinforcement wires 31 attached to steel case 27. A solid propellant is poured into the hollow case 27 to form an integral rocket motor 33 (FIG. 4).

An outer layer of solid propellant 33 is cast about the reinforcing wires, as illustrated in FIGS. 4 and 5. An inner epoxy nozzle (not shown) is inserted into opening 29 (see FIGS. 3 and 4) to form a reduced diameter nozzle opening 35 (see FIG. 5). The cast and cured solid propellant of the incendiary submunition 7 is illustrated in FIG. 5.

Preferably, the rocket nozzle is lined with a non-incendiary, high temperature material such as, for example, graphite or phenolic. Further, in a preferred embodiment, the submunition is generally disk shaped, with at least one integrally formed rocket motor inside of the disk. The disk configuration is preferred because it is inexpensive to fabricate, and packages well into conventional munition delivery systems, such as bomb casings and hard structure penetrators.

Further, as discussed above, the burning outer surface of the disk (i.e., the bottom surface of the incendiary portion) levitates the disk above the ground, creating an air gap between the bottom of the disk and the floor of the target, which provides a number of useful features. First, the gases formed in this region (i.e., the air gap) produce a gas-cushion effect, which allows the disk to move around the target floor in a nearly frictionless mode, thus enabling rapid random movement throughout the target with very low applied thrust.

Second, it was discovered that when not thrusting, the disk begins to spin at an ever-increasing rotational velocity until it fragments, thus distributing/dispersing the remaining incendiary propellant around the target volume. It is believed that this rotational action is caused by frictional forces imparted by the escaping gases in the combustion zone in the gap between the burning bottom of the disk and the floor, and/or the Coriolis effect.

A third desirable effect produced by the gas gap between the bottom of the disk and the floor of the target during combustion of the incendiary portion is that the confined burning produces a pressurized combustion zone, allowing more complete combustion of the metal products and a larger mass flow of extremely hot particles, in comparison to those combustion regions burning within a normal atmospheric pressure on the other surfaces of the disk. The jets from this gap also reach out more than an additional diameter of the original device, thus resulting in more coverage of the target volume by the heated products.

Figure 6:
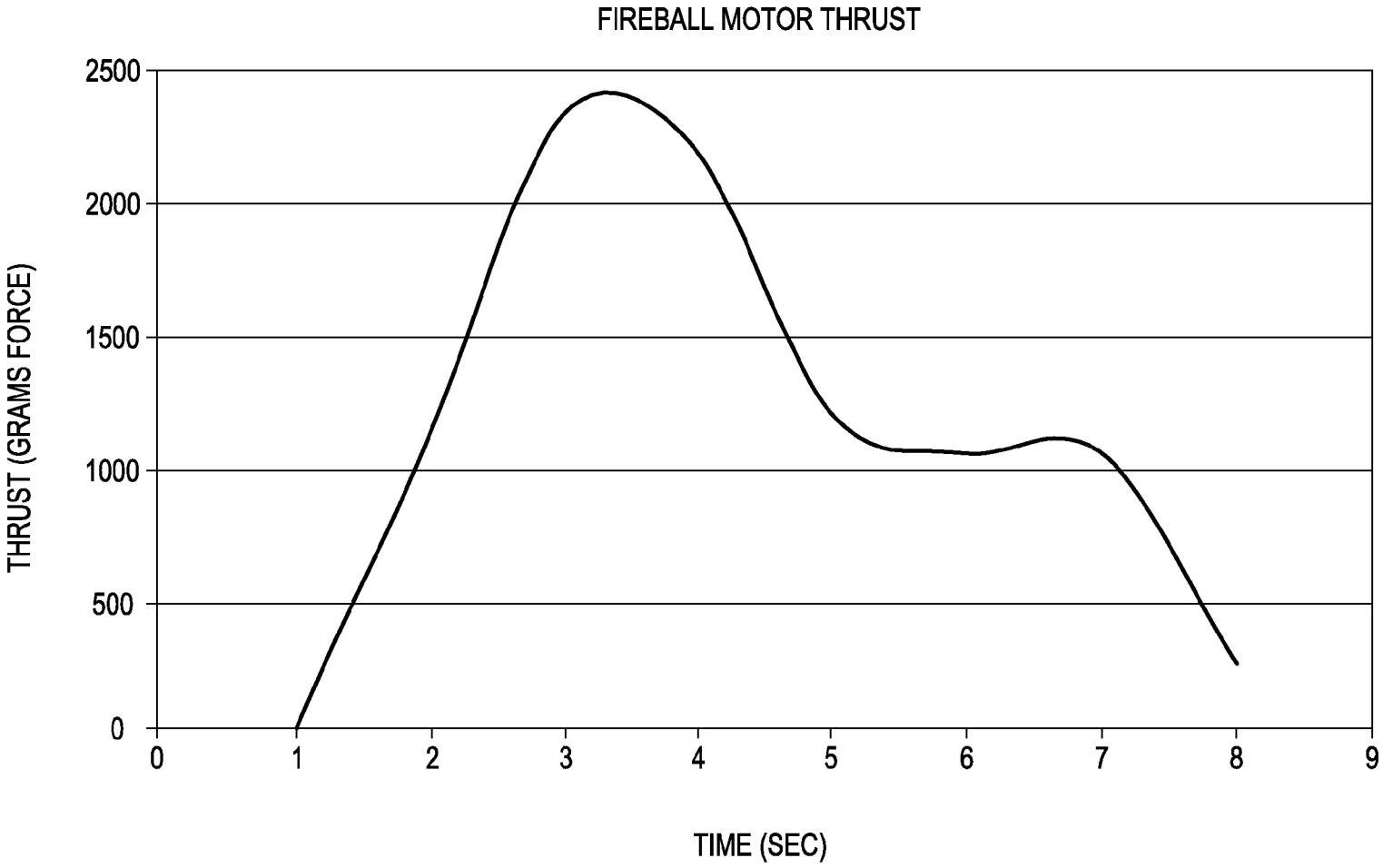
FIG. 6 is a graph of thrust versus time for a submunition rocket motor of the present invention.
Figure 7:
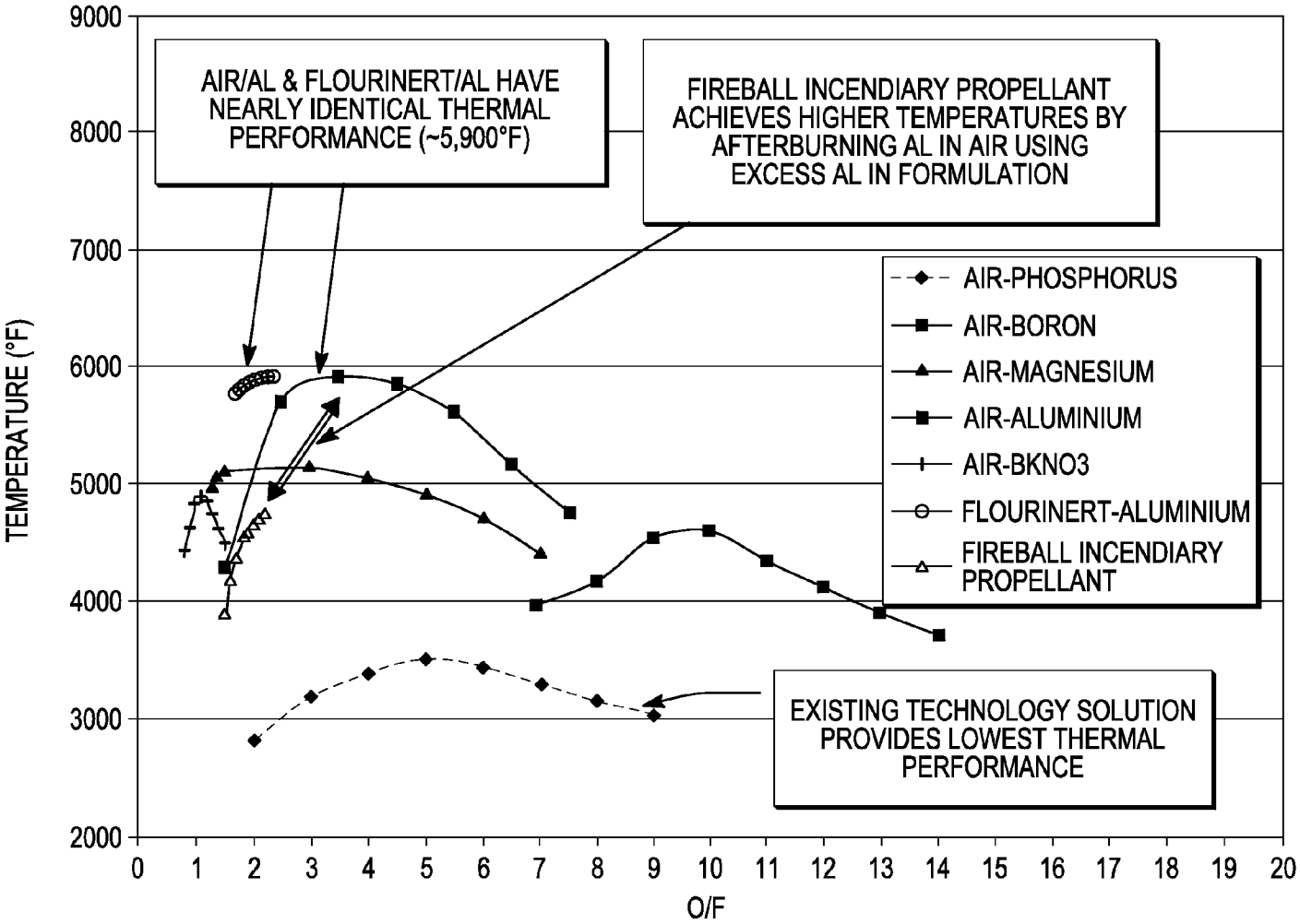
FIG. 7 is a graph comparing the thermal performance of existing phosphorous incendiary compositions with the thermal performance of a number of propellant compositions containing additional energetic additives according to the present invention.

The thrust of the rocket motors used to manufacture submunition 7, as illustrated in FIGS. 3-5, was tested, and the results of these tests, plotted as thrust v. time, are shown in FIG. 6. This plot illustrates that the maximum thrust occurred between 3 and 4 seconds after ignition of the rocket motor. A comparison of propellants with various energetic additives was made and plotted in a diagram of temperature versus oxygen/fuel, as illustrated in FIG. 7. The various combinations evaluated are shown in FIG. 7. It was found that a fireball incendiary propellant achieves higher temperatures by afterburning in air using excess in the formulation.

Figure 10:
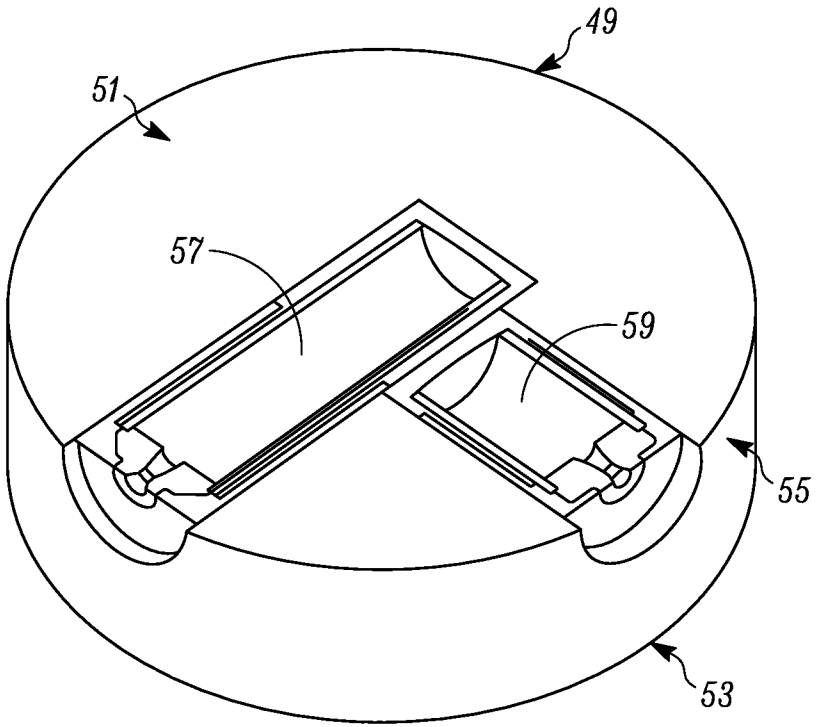
FIG. 10 is a perspective view, partially cut away, of an incendiary submunition disk of the present invention, illustrating the position of two rocket motors, and the orientation of their respective nozzles in the disk.

In some applications it is preferred to employ a disk shaped submunition containing at least two integrally formed rocket motors which have their respective nozzles pointed in different directions, as illustrated in FIG. 10. In a preferred embodiment, the two rocket motors fire sequentially, and in different directions, thus causing spinning of the submunition.

The incendiary munition of the present invention is designed to heat air to thousands of degrees Fahrenheit (° F.) in a few tens of seconds, as illustrated in FIG. 7, without causing a significant overpressure pulse. This overpressure must be avoided because it will destroy the structure being attacked and force dangerous biological and chemical agents into the environment. The present invention avoids significant overpressure in two key ways.

First of all, the incendiary propellant combusts in deflagration mode (wherein combustion occurs at less than the speed of sound in the combusting material) rather than as a detonation (wherein the combustion occurs at greater than the speed of sound in the combusting material), as is the case for high explosive approaches. Deflagration combustion typically proceeds at fractions of an inch to a few inches per second, and produces no significant overpressure. In contrast, detonations produce a strong pressure wave, result in significant undesirable overpressure, and proceed at a rate of kilometers per second.

In order to eliminate the possibility of undesirable detonation combustion in the submunitions of the present invention, a combination of carefully chosen chemistry and mechanical design is implemented. For example, the perchlorate and nitrate based ingredients that are most typically used to formulate the incendiary submunitions result in propellants that have large critical diameters, typically greater than about 60 to 70 inches.

A critical diameter is the dimension of the block of propellant that has to exist in order to allow the propellant combustion to exhibit detonation combustion. Even if this critical diameter condition is met, the detonation must be initiated by a powerful impulse, such as a large blasting cap or extremely large mechanical impact. Hence, detonation in the fireball submunition of the present invention is prevented by keeping the diameter of the submunition well below 60 inches, and avoiding the use of blasting cap type ignition devices.

Another consideration in avoiding detonation combustion is that of confinement. Devices intended to detonate must usually be confined in a bomb casing or rocket motor pressure vessel. This confinement allows the necessary conditions for detonation to take place. The fireball submunition of the present invention has no such containment means, thus further reducing any possibility of detonation with its resulting undesirable excessive overpressure.

Second, incendiary munitions made according to the present invention control the deflagration combustion in such a way that the rate of gas generation is approximately equal to the rate at which the gases exit the target structure through the penetration hole originally made by the munition or other gas escape paths in the structure. The rate of gas generation is controlled by the formulation of the incendiary propellant, by shaping of the incendiary submunition to limit the amount of combusting surface area, and by delayed, sequential ignition of the incendiary submunitions of the present invention.

In particular, incendiary munitions made according to the present invention control the deflagration combustion in such a way that the rate of gas generation is approximately equal to the rate at which, as discussed above, the gases exit the target structure through the penetration hole originally made by the munition or other gas escape paths in the structure. This equilibrium can be expressed in equation form as follows:

$$(dm/dt)_{gas\ generation}=(dm/dt)_{exiting\ structure}$$

The rate of gas generation is controlled by the formulation of the incendiary propellant, by shaping of the incendiary to limit the amount of combusting surface area, and by delayed, sequential ignition of incendiary submunitions.

These variables are then subject to the important theoretical consideration of the Ideal Gas Law, which is expressed as:

$$PV=nRT$$

where P is the pressure of the gas, V is the volume in which the gases are contained, n is the number of moles, and T is the temperature of the gas. R is called the gas constant and is sometimes referred to as the universal gas constant.

During the operation of the fireball submunitions of the present invention, a number of these terms are essentially constants for the purposes of designing the munition to minimize overpressure. The low overpressure constraint makes P a constant. T becomes a practical constant because of the requirement to maintain the target room a high but relatively constant temperature. As a result, one can define the constant $k_1$ as:

$$k_1=P/RT$$

then the Ideal Gas Law can be rewritten:

$$n=k_1V$$

As the submunition combustion process takes place, additional moles of gas will be produced. The implication of the restated Ideal Gas Law equation is that the effective volume that the gas can occupy must increase proportionally to the increase in the number of moles of gas produced. The fireball submunitions achieve this by being designed such that only the number of moles of gas are released that can exit the targeted facility at a rate that does not result in back pressuring of the room. In effect, the space surrounding the target facility becomes volume that the escaping gas molecules can occupy.

In particular, a key method to prevent overpressure is to formulate the incendiary propellants to combust at moderate burn rates (i.e. much less than about 1 inch per second, based on the diameter of the submunition). Solid rocket and incendiary propellants combust according to the equation:

$$dr/dt=aP^n$$

where dr/dt is rate at which the propellant combusts in the units of inches per second, a is the slope of the curve, P is the pressure at which the propellant is combusting in the units of pounds per square inch, and n is the burn rate exponent.

The kinetic fireball incendiary submunition of the present invention combusts at a pressure of about 1 atmosphere (i.e. 14.7 pounds per square inch). Combustion at this low-pressure usually proceeds at low to moderate rates. The burn rate exponent, n, in the present invention is typically not less than about 0.2, and not greater than about 0.5. The resulting burn rate is typically about 0.03 inches per second or less. Even this low burn rates was only made possible with the addition of burn rate catalysts, such as ferric oxide. The burn rate is typically catalyzed in order to enhance the gas cushion effect that levitates the submunition above the ground and away from obstacles that might hinder its translation within the targeted facility.

The submunition creating the fireball relies on highly exothermic reactions with oxidizers contained in the munition and the surrounding air. Oxidation reactions may include reactions with oxygen, nitrogen, carbon and halides.

Although the submunition of pyrotechnic material can take any form, in a preferred embodiment it is shaped into a sphere, block, disk, spheroid, or ellipsoid that can be ignited internally and externally upon command. For example, as discussed above, a preferable embodiment is a disk-shaped submunition, similar to a hockey puck, shown generally at 49 (see FIG. 10) comprises parallel flat surfaces 51, 53, and a circular side wall 55. As one or more of the flat surfaces 51, 53, formed of solid propellant, combust, the disk-shaped submunition is levitated off of the ground. One or more rocket motors 57, 59, embedded in or formed integral within the disk provide propelling thrust to the burning disk 49. Rocket motors 57, 59 are preferably oriented at about a 90° angle from one another, so as to cause the disk to spin, and are preferably designed to fire in sequence.

After ignition, the submunition then moves through a target volume using its own thrust, while at the same time transferring the metal combustion energy to the surrounding environment and air by radiation, convection, and conduction from ejected oxide particle jets. The incendiary munition of the present invention is essentially a high temperature object moving through the environment of a target volume with velocities sufficient to heat large volumes of quiescent air in the target.

Although any type of conventional incendiary material can be used in the incendiary munitions of the present invention, it is preferred to utilize conventional solid rocket motor propellants and incorporate therein incendiary materials selected from the group consisting of phosphorous, boron, magnesium, aluminum, liquid fluorocarbon (such as, for example, Fluorinert™)-aluminum and $BKNO_3$.

Figure 11:
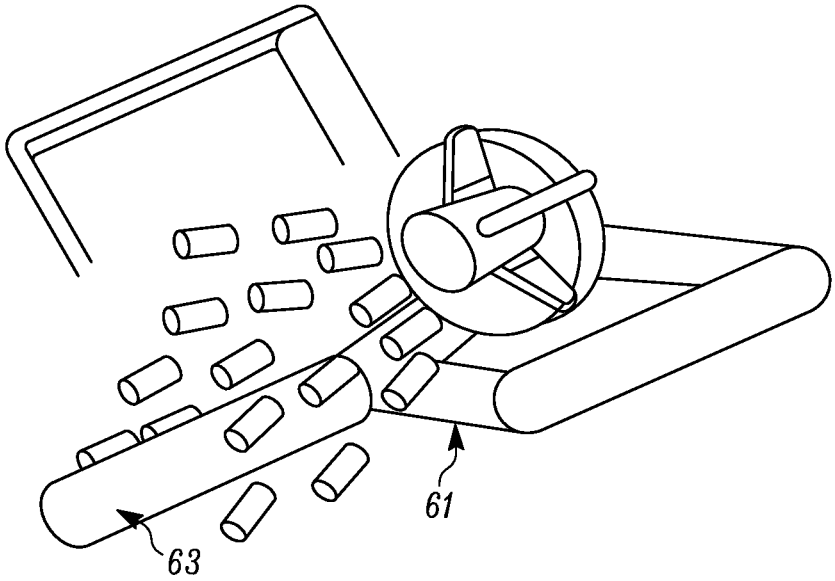
FIG. 11 is a perspective view of an incendiary munition of the present invention immediately after the casing for the incendiary munition has separated and released submunitions for dispersal.
Figure 12:
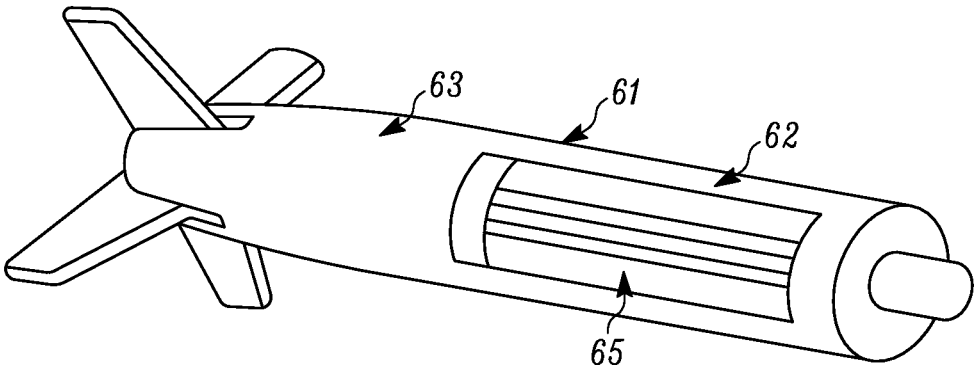
FIG. 12 is a perspective view, partially cut away, of the incendiary munition of FIG. 11, illustrating the position of the submunitions in the outer casing.

Preferably, the incendiary submunitions of the present invention are incorporated into an outer case, which may, optionally, have blow off panels to facilitate distribution of the submunition from the case. In another preferred embodiment, shaped line charges are used in the outer case to blow away remnants of the penetrator case, thereby allowing fireballs to self-disperse under their own thrust. In yet another embodiment, the fireballs exit from the aft end of the penetrator case. For example, an incendiary munition of the present invention shown generally at 61, as shown in FIGS. 11 and 12, may utilize a conventional CBU-97 casing 62 with blow off side panels 63, as the casing portion of the incendiary munition of the present invention. In such a configuration, the incendiary submunitions 65 are disposed within the casing 62, in side case 62, as illustrated in the cutaway section of FIG. 12. During use, the blow off side panels 63 are blown away, and the submunitions 65 are dispersed/fall away from casing 62, as illustrated in FIG. 11.

In some applications, it is required that a fireball munition (i.e., an incendiary munition) of the present invention heat up a targeted room to over 600° C., and maintain that temperature for at least 2 minutes. In a preferred embodiment, these temperature conditions can be achieved with the munition of the present invention using delayed ignition of a plurality of submunitions ("fireballs") of the present invention. The fireballs are inserted into a targeted room by the incendiary munition of the present invention. The load of fireballs is divided into groupings, preferably three groups. The first group of fireballs ignite immediately, while the second group remains inactive during operation of the first group and for a delay of some seconds afterwards. The second group of fireballs then ignites and performs its incendiary mission.

A third group of fireballs remains inactive during the operation of the first and second group, and for a delay of some seconds afterwards. The third group of fireballs then ignites and performs their incendiary mission. This sequential ignition pattern allows the pressure and the temperature inside the target structure to be maintained at the desired level of intensity for an extended period of time.

Figure 13:
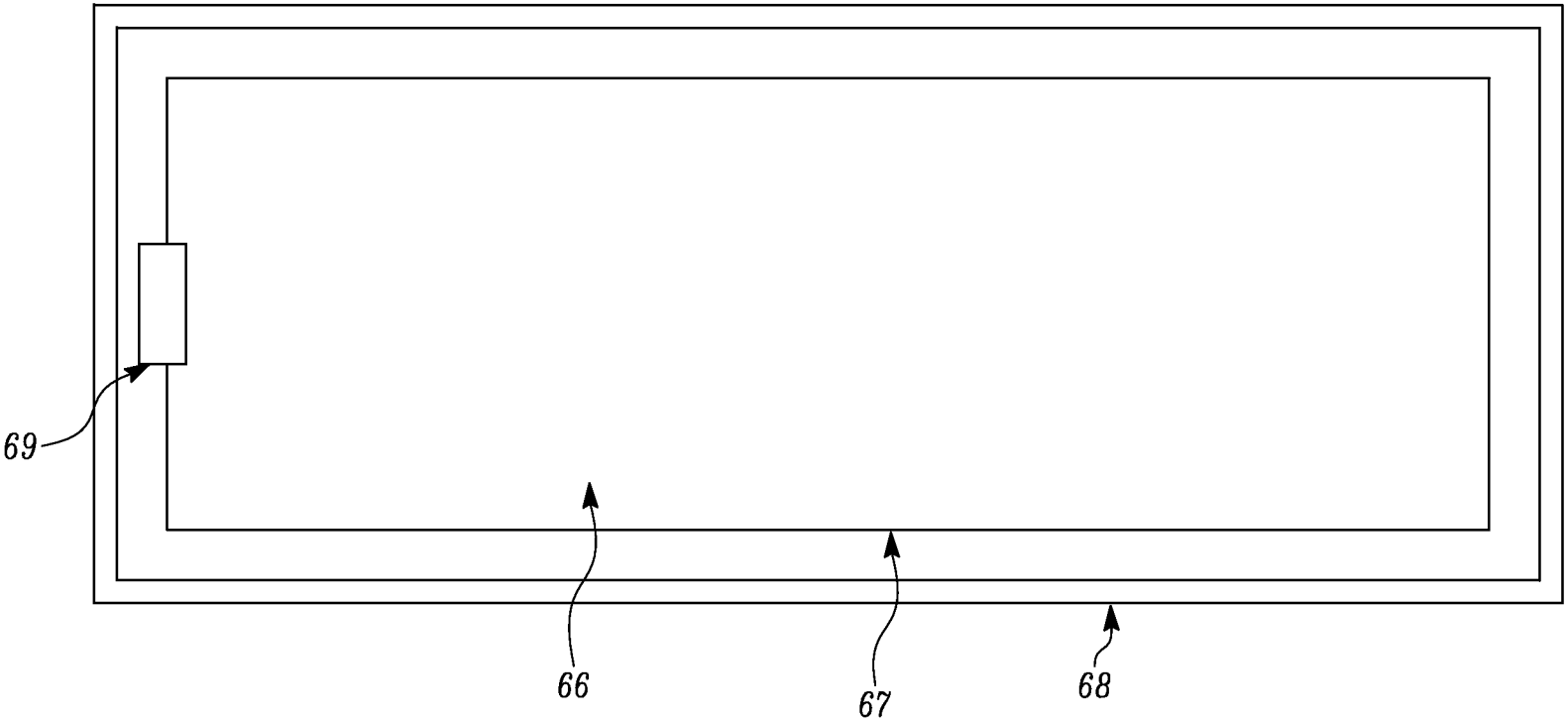
FIG. 13 is a cross sectional view of a delayed ignition type of incendiary munition according to the present invention.

An incendiary munition of the present invention of the delayed ignition type, as described above, is illustrated in FIG. 13. As shown therein, the submunition 66 is surrounded by an insulating layer 68. An insulating lubricant 67 resides between the submunition and the insulation layer. An ignition fuse 69 is attached to the submunition inside the insulating layer.

To create the desired ignition delay, the incendiary submunition comprises a fireball propellant that contains a rubbery binder to hold together the energetic, solid filler ingredients, and to give each fireball its structure. A layer of this binder, such as HTPB, without energetic filler ingredients, is placed over each fireball as an insulating layer. A thin layer, preferably about ¼ to 1 mm thick, of petroleum based lubrication is disposed between each fireball and the insulating layer to prevent chemical or other forms of bonding between the two surfaces.

The insulating layer is designed to be of a thickness such that it can withstand the corrosive and thermal environments generated by the fireballs that ignite before it. Generally, the insulating layer is about 1-10 mm thick. The fireballs could ignite if they experience a temperature of 450° F. or more on any propellant surface, so it is important in such a delayed ignition configuration to prevent same by the inclusion of the insulating layer.

Each fireball is provided with a fuse that times the ignition event relative to the time that the fireballs are first inserted into the room by the incendiary munition of the present invention. At the designated time, the fuse initiates an ignition event between the insulating layer and the outside surface of the fireball. The gases that are generated from the combustion of the incendiary propellant on the outside of the fireball generate a modest pressure. This modest pressure will cause the insulating layer to blow off of the fireball (the incendiary portion of the incendiary submunition). This process starts when the pressure reaches about 1 psi. The fireball then proceeds to perform its incendiary mission. Thicker layers of insulation can be used when longer ignition delays times are desired.

Preferably, the solid propellant in the submunition of the present invention is comprised of a binder, a solid oxidizer, and a light metal fuel. Preferably, the binders are generally organic materials such as polymers containing the elements C, H, O, Cl, F and N, or fluorocarbons or silicones. These binders may, optionally, contain plasticizers of the same classes of compounds and curatives. The binder materials preferably contain energetic moieties such as nitro, nitrato, azido, or difluoramino groups.

Preferred solid oxidizers may be metal nitrates, metal perchlorates, nitramines, nitro, or azido compounds. Minor amounts of ballistic additive may be added to modify the burning rate and combustion of the composition. In a preferred embodiment, the polymeric binders can be filled with about 70 volume percent of mixtures of a solid metal and oxidizer particles having size ranges of from about 1 to 1000 microns. More preferably, the sizes of multimodal blends are in the 10 to 400 micron range.

Preferably, the weight ratios of the solid oxidizer to fuel can range from about 1 to 4, more preferably, from about 3.2 to 3.6. It has been found that when low oxidation ratio formulations are used, there occurs some secondary heat release from the reaction of nitrogen with the molten metal when the metal nitride is formed. This additional heating from any unburned metal released to the target air volume assists in thermalizing the target.

The above-mentioned large variety of conventional binders and oxidizers can be used to assist in getting the metal fuels melted, ignited, and partially oxidized before they enter the air volume of the target. The preferred energetic metal fuels are mixtures, alloys or pure powders of magnesium, aluminum, boron, beryllium, and lithium, with the magnesium and aluminum being preferred. In the most preferred embodiment, the metal fuel in the propellant is aluminum and/or magnesium, with strontium nitrate and/or an ammonium perchlorate oxidizer, and a hydroxy terminated poly butadiene (HTPB) binder.

A metal filled liquid obduration fluid, such as a fluorocarbon liquid (Fluorinert® being a commercially available variety of same) mixed with a fine aluminum powder, is preferably used to fill the void volume in and between the incendiary submunition and the casing and other incendiary submunitions. This obduration fluid helps to protect the structural integrity of the submunitions during the violent deceleration experienced during the penetration of the munition into the targeted structure. It also adds to the incendiary energy of the overall munition.

Preferably, fireball propellant compositions include light metal elements of the periodic table that are highly exothermic when combusted with oxygen. The propellant is formulated so as to issue a mixture of metal and metal oxide that will ignite and/or heat ambient temperature air in the target volume. It is desired to heat this air as promptly as possible to a temperature that will destroy all organic materials present. Another factor driving the formulation of the incendiary material is to use enough exothermic materials to lengthen the pulse of the heat delivery, so that heat delivery is sustained for a number of seconds, without severely over-pressuring the target air volume to a point where the contents of that volume are dispersed beyond the original volume, e.g. limit collateral damage.

A preferred incendiary propellant formulation is shown in Table 1 below.

TABLE 1

| Kinetic Fireball Propellant Formulation Ingredient | Percent Mass |
|---|---|
| Ammonium Perchlorate (200 Micron) | 25 |
| Ammonium Perchlorate (90 Micron) | 25 |
| Ammonium Perchlorate (15 Micron) | 10 |
| Magnallium - 325 (325 Micron Mesh) | 10 |
| Red Iron Oxide | 2 |
| R-45 | 15 |
| DOA | 6.2 |
| Papi-901 | 2.1 |
| Tepanol | .2 |
| Castor | .4 |
| Lecithin | .1 |
| FIG. 1 | |

Preferably, the submunition of the present invention is tailored to the mission to be performed. For example, for targets having a large air volume, the submunition composition can be tailored to the fuel rich side by increasing the amount of metal fuel, and relying on the air in the target volume to supply a portion of the oxygen to combust with the metal. This gives an overall increase of delivered enthalpy per unit mass of munition.

The type of metal and/or alloy used in the propellant may also be selected on this basis. For example, calculations for boron vs. oxygen/fluorine (O/F) show a more level output as O/F changes, than does aluminum and magnesium. Another factor is the formation of the metal nitride when the oxygen is exhausted. By tailoring for this reaction, the delivered enthalpy to a target volume can be further enhanced.

The flexibility of the incendiary munition of the present invention is illustrated by the fact that it can take advantage of materials such as water in the target environment, and use the water as an oxidizer for the hot metal emanating from the munition. For example, for missions involving the destruction of chemical or biological agents contained in bunkered storage vessels containing these materials in water suspensions, the molten metal cloud emanating from the munition will react with the water, using it as an oxygen source for further heat liberation to destroy the target materials.

Additionally, molten metal sprays emanating from the munition react readily with nitrogen in the air in the target facility. This reaction is important after the oxygen is depleted, since nitrogen is the less thermodynamically favored product.

The incendiary munition of the present invention offers multiple mechanisms for the destruction of organic materials, such as chemical and biological agents, organic fuels, personnel and munitions. None of these targets can resist destruction at temperatures between 500 and 1000° F. for more than a few seconds. For such targets, the incendiary munition of the present invention can be tailored to raise the temperature of the volume of the target facility to 1000° F. or higher within 10 seconds, and maintain this temperature for a requisite time interval. The temperature/enthalpy of the incendiary munition device can be tailored by altering the composition of the energetic material, and the burning time can be tailored by selection of the thickness of burning material and its rate of burning.

The submunition of the present invention delivers extraordinarily high heat flux by the impingement of the metal oxide jets onto nearby objects. For example, the heat flux can cut through ⅜" of steel in a fraction of a second.

The incendiary munition of the present invention is also capable of transferring and dispersing heat throughout the interior of the target by the extremely effective method of depositing aluminum oxide on those locations impacted by the fireballs. The slightly fuel-rich fireballs also deplete oxygen from the enclosed space. The overall room temperature is increased still further by the combustion of the fireball's excess aluminum fuel with the air to form aluminum oxide ($Al_2O_3$) and aluminum nitride (AlN). Finally, these submunitions travel throughout the target facility, causing the incineration of the entire interior of the building.

Kinetic fireball incendiaries (incendiary munitions) of the present invention can be integrated into current and advanced penetrating munitions to defeat hardened and underground targets. This approach is tailored to avoid massive explosive effects and minimize collateral effects, which could result in the release of dangerous agents. The penetrator/fireball system defining the incendiary munition of the present invention meets sensitive munitions transportation and storage requirements, and will survive penetration and deceleration loads.

For example, the fireball submunition of the present invention can be employed in a Department of Defense Penetrator BLU-10, and the advanced penetrating munition AUP. Shaped line charges can be used to blow away the remnants of the Penetrator case to allow the fireballs to self-disperse under their own thrust. In addition to guided munitions, the incendiary submunitions of the present invention may be used in smaller versions of these devices, such as shoulder fired rockets, guns, rifles and grenades, as well as armored vehicles.

FIGS. 1 and 2, as discussed above, show a cross-sectional view of an incendiary submunition of the present invention. These incendiary submunitions are rocket powered, very high temperature, rubber balls that bounce off walls and wreak havoc on objects in an enclosed facility, while heating up the interior volume of the enclosed facility to an extreme temperature. The payload is capable, after penetration into a hardened or underground facility, of self-dispersing up to 3,500° F. fuel-rich gases reacting with air and indigenous combustibles to raise internal temperatures to sufficient levels and for a sufficient period of time to destroy chemical and biological agents. This submunition is tailored to avoid massive explosive effects, and to minimize the release and dispersal of collateral effects.

Preferred incendiary munitions of the present invention are illustrated in FIGS. 1, 11 and 12. The submunition in FIG. 1 consists of several hollow spherical solid propellant "fireball" elements. The fireballs are designed to burn on the interior and exterior surfaces, and thrust themselves randomly around the facility to create afterburning and mixing of the ambient air to raise the interior air temperature. A thrust nozzle (analogous to a crude nozzle) can be cast into the shell to propel the fireball and enhance self-dispersal.

Liquid obduration, as discussed above, which uses a fluid of the same density as the solid propellant to surround the fireball elements, protects the fireballs during penetration and impact deceleration. Preferably, voids inside the fireballs, as well as the space around the fireballs, are filled with an obdurating liquid. The obdurating liquid works best when the liquid is approximately the same density as the material being protected. For this reason, a preferred obduration liquid is a fluorinated carbon liquid such as Fluorinert™.

Engineers normally seek to protect propellants from impacts. Yet, in the present invention, the propellant is intentionally accelerated into objects inside a bunker. Customarily, propellants are formulated with nearly balanced stoichiometry in order to achieve the maximum propulsive efficiency. Further, against conventional teachings, in the present invention the propellant is formulated to be fuel-rich and produce high temperature in order to deplete the oxygen from the room and heat it to the highest possible temperature. Also, the baseline fireball (the incendiary submunition of the present invention) is made entirely out of solid propellant. Hence, the solid propellant must serve as a pressure vessel, as well as a nozzle.

Kinetic fireball incendiaries of the present invention are capable of heating a room most effectively if they spend as much time as possible traveling through a three dimensional space of the room. As a fireball travels, it is convectively heating the room in a highly efficient manner. It may be difficult for a non-reinforced ball of propellant to hold enough pressure to, in turn, generate enough thrust to properly accelerate the ball. In a traditional rocket, acceleration would be low until the rocket had burned enough propellant to make it light enough. However, in the incendiary submunition of the present invention, as the propellant is consumed, the propellant web becomes thinner and, hence, the maximum expected operating pressure (MEOP), or the maximum pressure, the case can withstand will continually decrease.

Yet another complicating factor is that in a spherical propellant grain design, the surface area of the burning propellant will increase with time. This causes the pressure of the motor (chamber pressure) to increase over time. The pressure of the motor increases still further due to the fact that solid propellant generally burns faster as chamber pressure is increased. All of these things will balance to some degree by the fast erosion of a nozzle that is made up of solid propellant, which reduces chamber pressure as erosion occurs.

Preferably, the fireball produces a thrust force that is greater than its weight at any given time in order to allow it to travel through the three dimensional space of a targeted bunker. The internal pressure of the fireball preferably does not exceed about 400 pounds per square inch (400 lb/psi). This is the MEOP of the fireball, to prevent the fireball from pressure bursting.

In a preferred embodiment, the inner diameter of the nozzle throat is about 0.25 inches, and a diameter of a void inside the fireball is about 2 inches. As shown in the plotted data, the most common result during the simulations was for the motor to over-pressurize. It was discovered, however, that providing the fireball with an inner void diameter of 4.5 inches produces an acceptable chamber pressure which can be maintained if the throat starts out at a diameter of 0.9 inches or greater.

Large diameter kinetic fireball incendiaries require a more robust pressure vessel than that provided by the solid propellant itself. For this reason, a metal pressure vessel can be used in fabricating the submunition. Another key factor is the need for a rapidly eroding nozzle in order to keep the chamber pressure at reasonable levels. Traditionally, rocket designers do everything possible to minimize nozzle erosion. However, in the present invention, this particular conventional wisdom does not apply.

Chemical and biological weapons are often stored in hardened concrete and steel structures. For this reason, it was important to design a total munitions system that could introduce the kinetic fireball Incendiaries into a hardened target. The BLU-109 Penetrator, as discussed above, is one of the most effective off-the-shelf systems for the employment of kinetic fireball incendiaries. The BLU-109 is shown schematically in FIG. 11. This munition is about 100 inches long and 16.5 inches in diameter at its maximum. The main body is 14.5 inches in diameter with a 1-inch thick wall. It is traditionally loaded with 535 pounds of explosives. The hardened steel case and the momentum of this 1,967 pound munition allows it to penetrate through steel reinforced concrete and into the interior of structures after being airdropped from high altitudes.

When the BLU-109 Penetrator impacts a hardened bunker, it experiences extreme deceleration loads. These loads can exceed 30,000 g's. For this reason, the design of the overall munition needs to incorporate a means to keep the fireballs from fracturing or collapsing during the deceleration event. To ensure that the fireball elements survive and remain intact during penetration, liquid obduration, as discussed above, can be used to minimize damage to the fireballs. This method has been successfully demonstrated in the firing of propellant rockets from artillery without damage in Project HARP (conducted by McGill University and Lockheed Propulsion in the late 1960s). The solid propellant rockets withstood acceleration loading of 40,000-50,000 g's.

Sequential Firing of Submunitions

In order to achieve the goal of thermalizing the interior of a target structure to a temperature of around 1700° F. for a period of about five minutes, it is preferred to sequentially ignite a plurality of kinetic fireball incendiary submunitions inside of the target structure. The sequential firing of the submunitions can be effected employing any conventional sequential ignition means. This requires the use of incendiary submunitions which can withstand very high temperatures for up to about five minutes before its turn to ignite.

Computer modeling of this problem indicated that this goal of producing an incendiary munition capable of withstanding elevated temperatures for up to five minutes could be achieved using a relatively thin layer of insulation if the incendiary propellant is bonded to the outer insulation layer which minimizes heat transfer to the submunitions before they are ignited. However, it was initially believed that in order to become kinetic, the submunition must separate from the incendiary propellant during the ignition process.

A transient thermal analysis was carried out to determine what type and thickness of an insulation layer would be needed on the propellant to withstand a temperature of 1700° F. for about five minutes. In these tests the insulation used was composed of HTPB (hydroxy terminated polybutadiene) filled with silica ($SiO_2$) particles. Analysis and experimental results demonstrated that a properly designed interface between the insulation layer and the incendiary propellant allows the bulk of the propellant to act as a heat sink thus allowing the submunition to survive for longer periods of time in the high temperature environment without increasing the thickness of the insulation layer. This is important because the submunition has greatest effectiveness when the ratio of incendiary propellant mass to inert mass is at its greatest.

In the initial tests, the insulation totally enclosed a disk-shaped propellant approximately eleven and a half inches in diameter and six inches high. The purpose of the insulation layer was to protect the propellant grain from premature ignition within a period of approximately five minutes while exposed to randomized radiative heat loads at high intensities. Two different thicknesses of insulation were tested, a first insulation about one-fourth of an inch thick and a second insulation about one-half of an inch thick. Two different radiative heat transfer model scenarios were tested. In a first model the insulation layer adjoined the body of the propellant grains and in a second model the insulation did not contact a propellant grain.

In the first scenario the bulk of the propellant grains can absorb some portion of the thermal energy through conduction, but this requires a bond between the two materials. The results of this thermal test are set forth below in Table 2.

TABLE 2

THERMAL ANALYSIS RESULTS

| | Model Setup | | | |
|---|---|---|---|---|
| | ¼" EPDM Thickness Propellant | No Propellant | ½" EPDM Thickness Propellant | No Propellant |
| Time when Temp = 275° C. On Back Face of EPDM | ~4 min | ~1 min 45 sec | >5 min | >5 min |

It can be seen from the above Table 2 that the bonded propellant approach is superior to the unbonded propellant and that an insulation thickness of less than one-half inch is all that is necessary. In some instances, the unbonded approach led to insulation inflation followed by a burst in a given location leaving a fireball trap.

Within each of the above-identified scenarios the incident radiation was focused upon the front open face of the insulation layer, i.e., the face that was closest to the radiation source. The propellant used was designed to ignite at or around 270-275° C. Thus, to be effective, the insulation must keep the surface of the propellant below this critical temperature.

It was therefore desirable to provide a kinetic fireball incendiary which is reliable and repeatable insulation separation from the submunition at ignition. However, in early tests, the insulation layer failed to separate cleanly from the propellant grains.

Consequently, a number of approaches to solve this problem were tested. These included (1) directly coating propellant on to the insulator, (2) placing a high temperature grease coating on the surface of the insulator which is in contact with the propellant, and (3) placing a non-stick coating layer on the insulation to interfere with the bond between the propellant and the insulation.

In tests of a direct cast of propellant on to a circular insulator, it was found that the insulator did not separate, but instead, the insulator burst in the vicinity of the igniters. For this reason, the direct cast of propellant approach was abandoned.

After considerable experimentation the inventors discovered an incendiary submunition which could be fired in sequence to produce unexpectedly high temperatures extending over a period of up to about five minutes to thermalize the interior of a target to a high enough temperature to neutralize chemical and biological agents. In this submunition a thermal insulation layer covers all of the surfaces of the disk-shaped submunition. The propellant is completely bonded everywhere to the insulation layer except on a large portion of the top and bottom surfaces. On these unbonded top and bottom surfaces the insulation layer is scored or otherwise weakened so as to allow ignition pressure of the ignited propellant to blow out the pre-weakened areas of the top and bottom portions of the insulation layer, as shown in FIG. 14.

Figure 14:
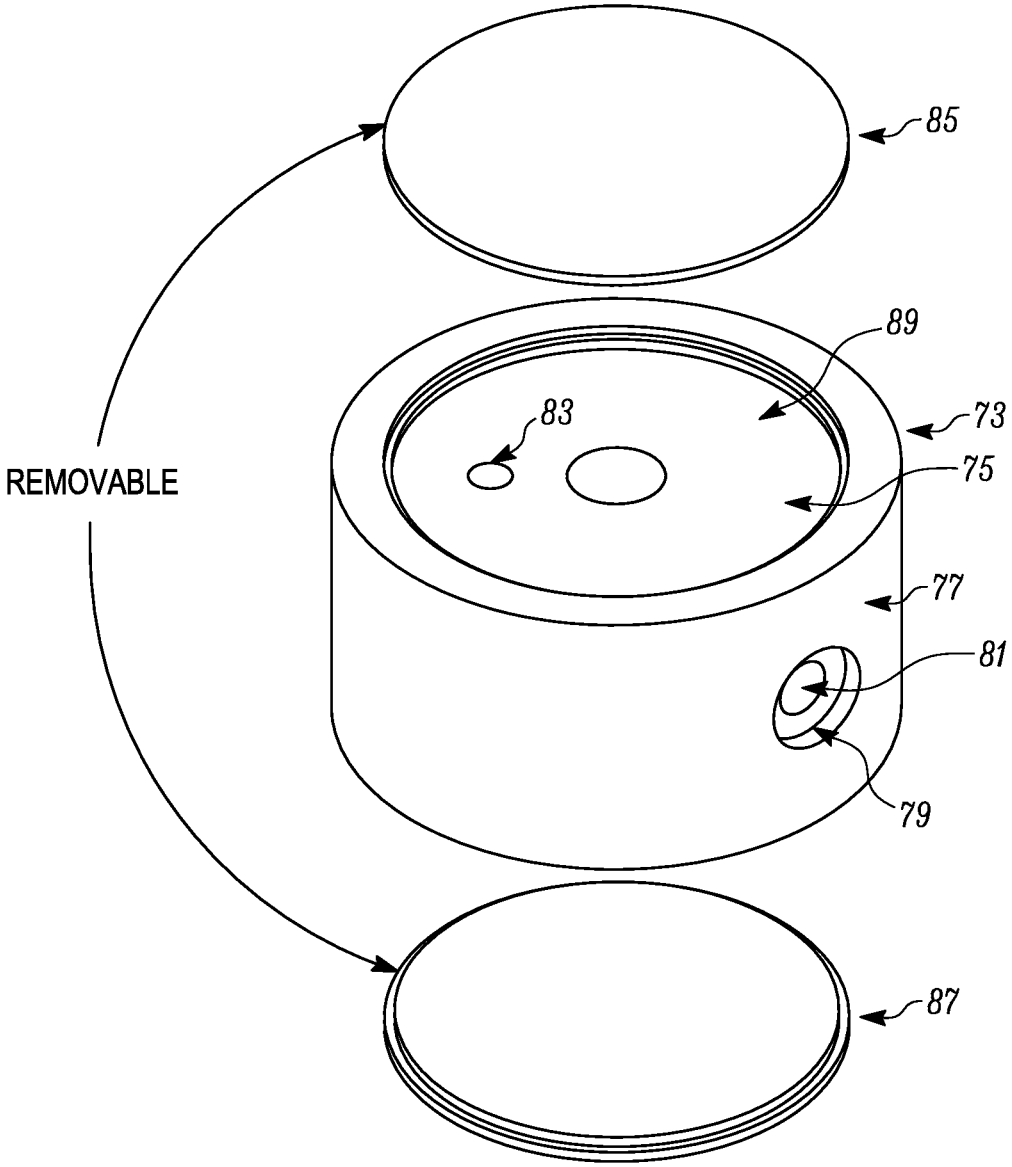
FIG. 14 is an exploded perspective view of a disk-shaped incendiary submunition of the present invention, illustrating the insulation layer being blown away from a portion of the top and bottom surfaces so as to facilitate ignition of propellant on those surfaces.

In particular, as shown in FIG. 14, in a preferred embodiment of the disk-shaped incendiary submunition shown generally at 73, the propellant 75 is bonded to an outer insulation layer 77. Internal rocket motor shown generally at 79 can discharge propellant through a nozzle 81 (the insulation layer 77 being cut away around the nozzle 81). Preferably, an igniter 83 is positioned on a top surface of propellant 75. A similar igniter (not shown) is also positioned on the bottom surface of propellant 75. In this cutaway illustration in FIG. 14, a top portion 85 of thermal insulation and a bottom portion 87 of the thermal insulation are illustrated after they have been blown away from the top and bottom surfaces of the submunition 73.

In a preferred embodiment the cutaway portions 85 and 87 can be coated on their inner surfaces with a non-stick coating to facilitate a clean separation of the insulation upon ignition. The insulation 89 on the top surface of submunition 73 has been scored or otherwise weakened in a circular pattern as shown to facilitate the removal of the circular insulation portion 85. The insulation on the bottom surface of the submunition is similarly scored or weakened to facilitate the blowout of the circular bottom portion 87.

In a preferred embodiment, two hot wire pyrogen igniters are used, one being used to ignite the bottom surface of the submunition which causes the weakened area of insulation on the bottom to blow out and the ignited propellant on the bottom causing the submunition to levitate on a cushion of hot gases. The other pyrogenic igniter is positioned on the top of the fireball which is used to blow off the top cover.

In a preferred embodiment, combustion on the bottom of the fireball ignites a cannon fuse which burns into a rocket motor nozzle and ignites pyrogen at the end of the fuse. Then, the pyrogen ignites the rocket motor propellant and the rocket blows a hole through the scored and/or weakened insulator side. (See FIG. 14)

Figure 15:
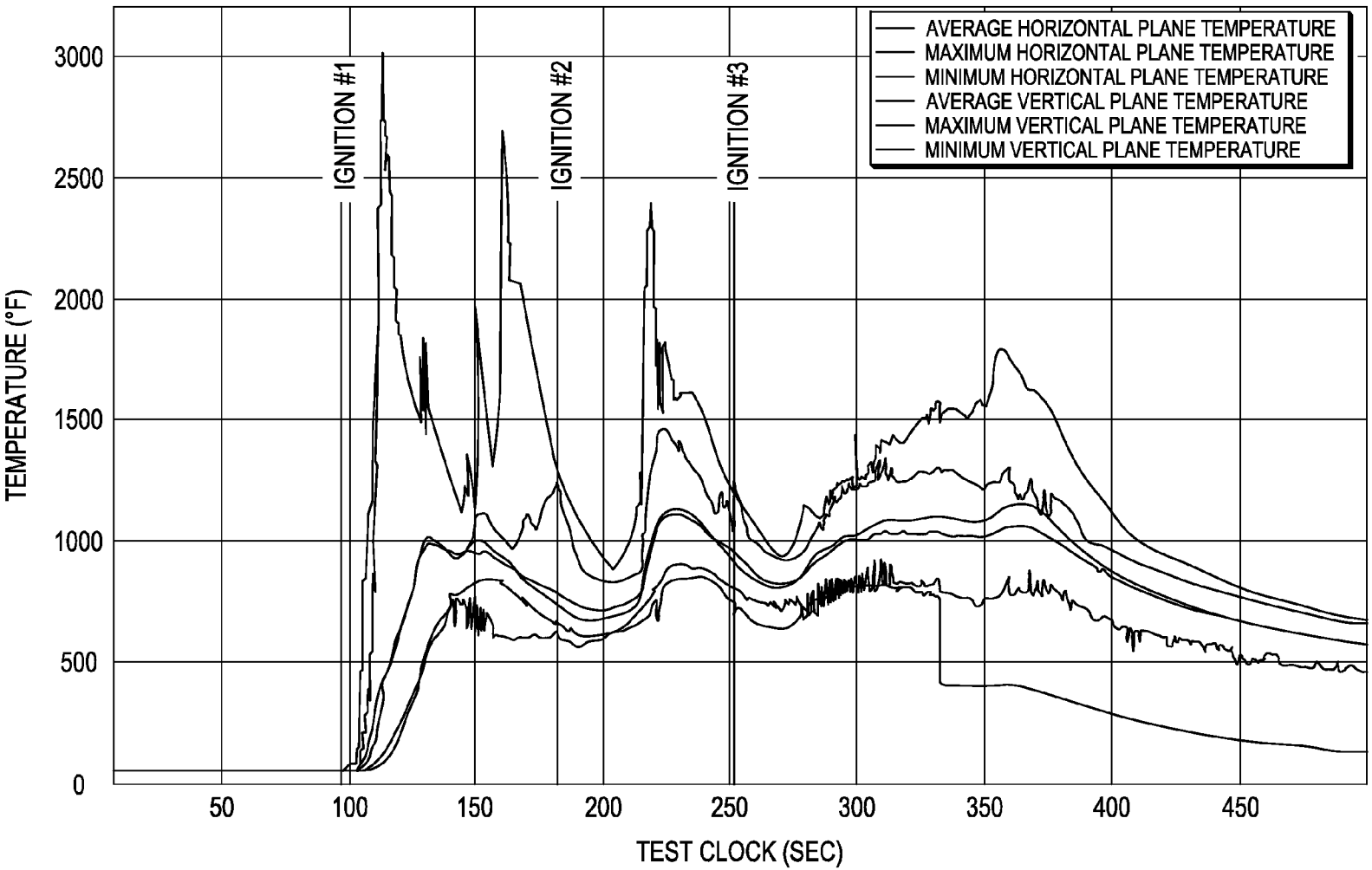
FIG. 15 is a graph of temperature versus time measured in an enclosure when three disk-shaped incendiary submunitions of the present invention are sequentially ignited in an enclosure.

Tests employing three disk-shaped submunitions fired in sequence in an enclosure measuring twelve feet by twelve feet by eight feet elevated temperatures in the plot of temperature versus time shown in FIG. 15. In this plot, the average horizontal plane temperature, the maximum horizontal plane temperature, minimum horizontal plane temperature, average vertical plane temperature, maximum vertical plane temperature, and minimum vertical plane temperature are shown.

Figure 16:
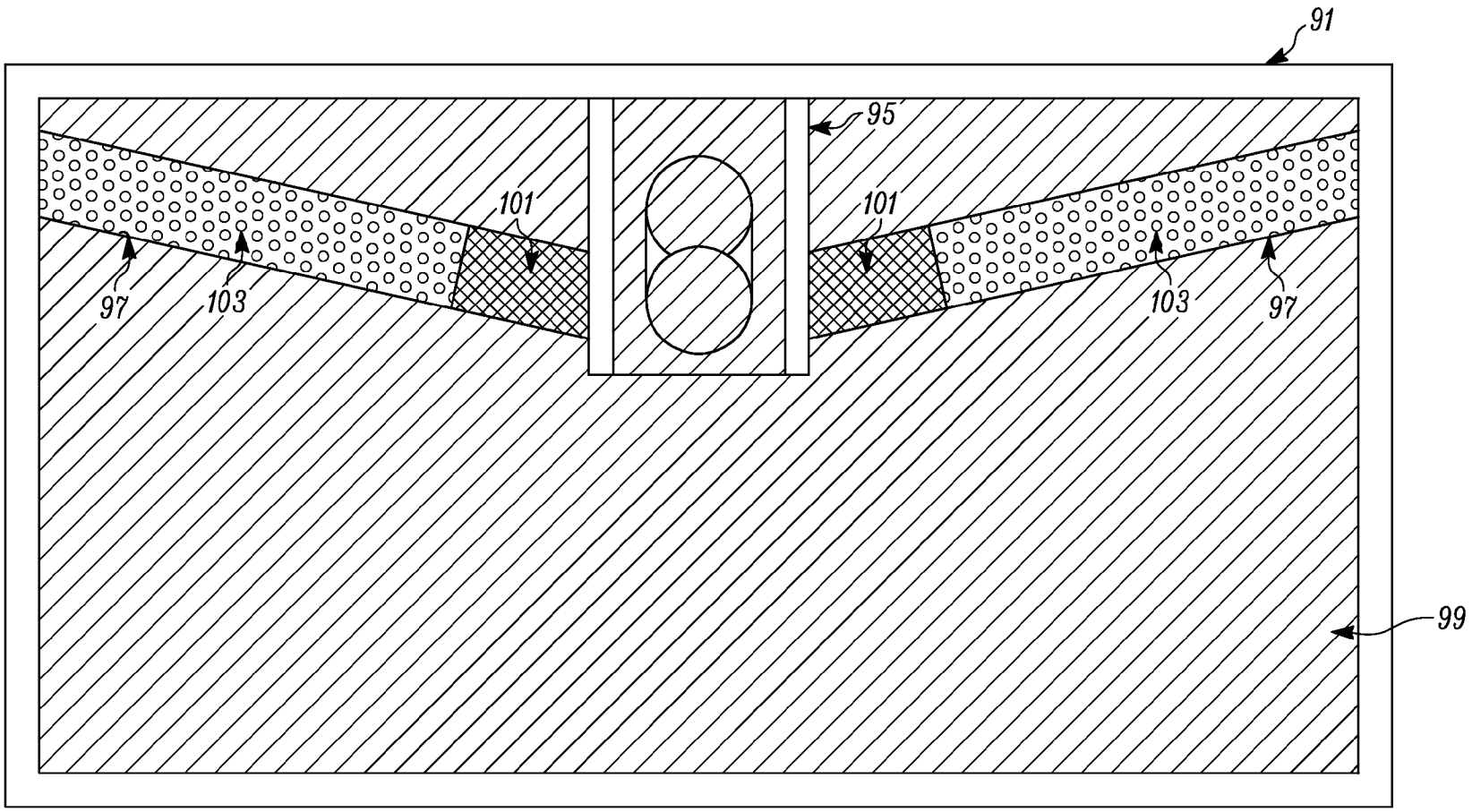
FIG. 16 is a cross-sectional side view of a preferred incendiary submunition of the present invention, illustrating the generally disc-shaped submunition having a central thrust structure to which are attached one or more barrels, each containing a powder charge and a projectile.

In another preferred embodiment illustrated in FIG. 16 there is provided a generally disc-shaped incendiary submunition 91 having an outer insulating layer 93, a centrally positioned thrust structure 95 and one or more barrels 97 attached or affixed to thrust structure 95. Thrust structure 95 with attached barrels 97 form a ring structure which is embedded in propellant charge 99 of disc-shaped incendiary submunition 91. Barrels 97 radiate outwardly from thrust structure 95 like radial spokes of a wheel.

Figure 17:
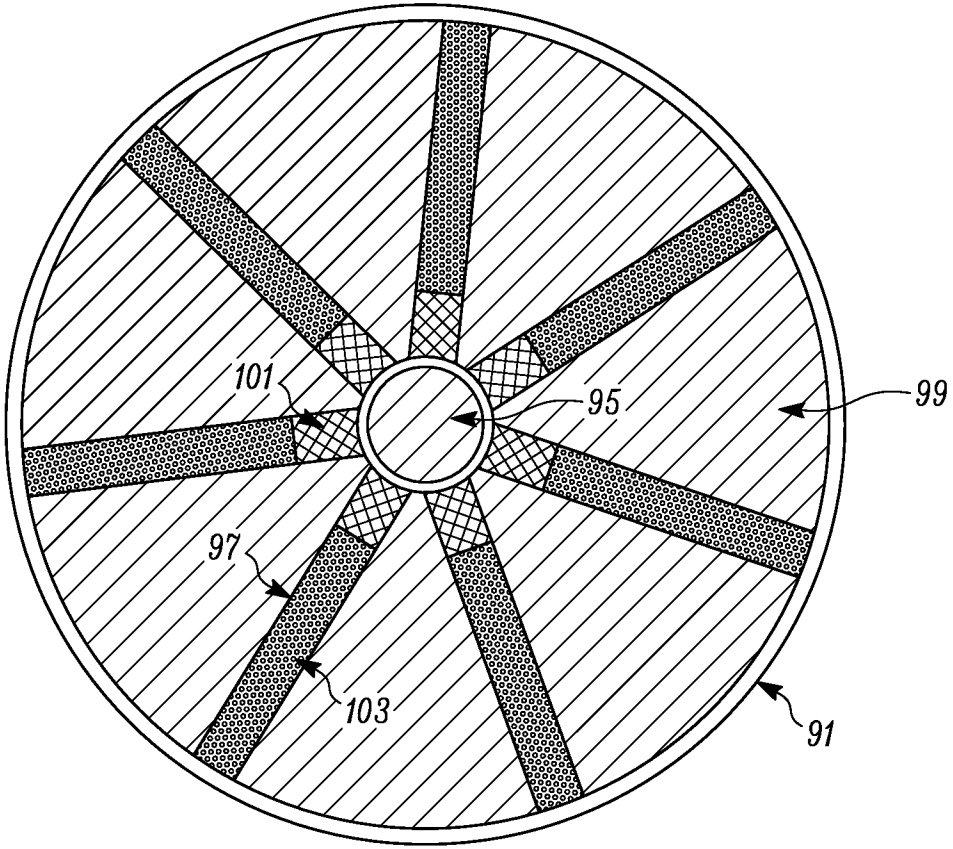
FIG. 17 is a top sectional view of the incendiary submunition of FIG. 16, illustrating in particular the plurality of barrels attached to a central thrust structure, and the position of powder charges and projectiles in each of the barrels.

Each of barrels 97 are loaded with a conventional gunpowder charge 101 and various types of projectiles, primary slugs, or buckshot 103. (FIGS. 16 and 17) Shotgun tubes or barrels 97 are arranged to fire radially outwardly from fireball submunition 91. In a preferred embodiment shown in FIGS. 16 and 17, the shotgun tubes or barrels 97 are oriented at an upward angle when the bottom of the submunition 91 is horizontal or parallel to a floor. This orientation of barrels 97 prevents fratricide (i.e., one fireball from shooting another fireball) and allows submunition 91 to fire upwardly, thus imparting and damaging any chemical/biological agent vessels placed on the floor, on the top of work benches and/or shelving. The end of barrels 97 are inside insulation layer 93.

In operation, when the powder charge 101 fires, it blows a hole (not shown) in insulation layer 93. The projectiles travel away from the fireball (submunition 91) and damage any chemical/biological agent vessels. The generated equal but opposite reaction forces cause the fireball to travel in an opposite direction while floating on a cushion of nearly frictionless hot combustion gases.

The shotgun tubes 97 can be fired sequentially or in any desired order using a conventional fusing train (not shown) that can be ignited at the same time as the powder charges 101. Preferably, the shotgun version of submunition 91 shown in FIGS. 16 and 17 has a right side up. The powder of the shotgun impulse and the angle of the barrel is designed so that the fireball if ignited while upside down will flip itself into a right side up orientation when the first shotgun tube 97 is fired. Basically, submunition 91 is the same fireball as described above except that it is provided with integral multiple radially extending barrels rather than integral rocket motors.

Although specific embodiments of the present invention have been disclosed herein, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

LIST OF DRAWING ELEMENTS

3: outer shell or bomb casing 3
7: submunitions

9: fuse
11: outer propellant layer
13: inner propellant
15: steel case
17: rocket motor
19: propellant chamber wall
21: passage 21 defining a rocket nozzle
23: nozzle liner
25: phenolic plate
27: hollow spherical steel case
29: top
31: reinforcement wires
33: integral rocket motor
35: reduced diameter nozzle opening
49: disk-shaped submunition
51, 53: parallel flat surfaces 51, 53
55: circular side wall
57, 59: rocket motors
61: incendiary munition
62: conventional CBU-97 casing
63: blow off side panels 63
65: incendiary submunitions
67: insulating lubricant
68: insulating layer
69: ignition fuse
73: submunition
75: propellant
77: outer insulation layer
79: internal rocket motor
81: nozzle
83: igniter
85: top portion
87: bottom portion
89: insulation
91: disc-shaped submunition
93: insulation layer
95: thrust structure
97: barrels
99: propellant
101: powder charge
103: projectiles

What is claimed is:

1. A system for thermalizing an interior volume of a target structure, comprising:

a plurality of incendiary munitions, each incendiary munition including an incendiary portion, an oxidizer for the incendiary portion, a fuse that initiates an ignition event, an insulation layer surrounding the incendiary portion, and an insulating lubricant layer disposed between the incendiary portion and the insulation layer; and the incendiary munitions are configured to ignite sequentially, wherein:

a first one of the plurality of munitions is configured to ignite first; and a second one of the plurality of munitions is configured to ignite a delay time after the first munition ignites.

2. The system of claim 1, further comprising:

a third one of the plurality of munitions is configured to ignite a delay time after the second munition ignites.

3. The system of claim 1, wherein the incendiary munitions are configured such that the interior volume of the target structure is heated to a temperature of over 1000 ° F. that is maintained for a period of time.

4. The system of claim 3, wherein the period of time is at least five minutes.

5. The system of claim 1, wherein each incendiary munition includes a bottom surface that faces towards a floor of the target structure so that when the incendiary munition is ignited, a mass flow is directed from the bottom surface toward the floor.

6. The system of claim 5, wherein the mass flow levitates the incendiary munitions above the floor.

7. The system of claim 6, wherein each incendiary munition is disk-shaped.

8. The system of claim 5, wherein a portion of the insulation layer surrounding the bottom surface of each incendiary portion is configured to be blown away to expose the bottom surface of each incendiary portion.

9. The system of claim 5, wherein the bottom surface is flat.

10. The system of claim 1, wherein the insulation layer comprises a polymer binder and wherein the insulation layer does not contain phosphorous, boron, magnesium, aluminum, liquid fluorocarbon-aluminum or $BKNO_3$.

11. The system of claim 10, wherein the polymer binder is hydroxy terminated polybutadiene.

12. A system for thermalizing an interior volume of a target structure, comprising: a plurality of incendiary munitions, each incendiary munition including an incendiary portion, an oxidizer for the incendiary portion, and a fuse that initiates an ignition event; and the incendiary munitions are configured to ignite sequentially relative to insertion into the target structure, wherein: a first one of the plurality of munitions is configured to ignite first following insertion into the target structure; and a second one of the plurality of munitions is configured to ignite a delay time after the first munition ignites, a third one of the plurality of munitions is configured to ignite a delay time after the second munition ignites; and wherein the delay time of the second one of the plurality of munitions is greater than the time over which the first one of the plurality of munitions is active, and the delay time of the third one of the plurality of munitions is greater than the period of time over which the second one of the plurality of munitions is active.

13. The system of claim 12, wherein the incendiary munitions are configured such that the interior volume of the target structure is heated to a temperature of over 1000 ° F. that is maintained for a period of time.

14. The system of claim 13, wherein the period of time is at least five minutes.

15. The system of claim 12, wherein each incendiary munition includes a bottom surface that faces towards a floor of the target structure so that when the incendiary munition is ignited, a mass flow is directed from the bottom surface toward the floor.

16. The system of claim 15, wherein the mass flow levitates the incendiary munitions above the floor.

17. The system of claim 16, wherein each incendiary munition is disk-shaped.

18. The system of claim 15, further comprising, for each incendiary munition, an insulation layer is disposed over the bottom surface, and the insulation layer of each incendiary munition is configured to be blown away to expose the bottom surface of each incendiary munition.

19. The system of claim 15, wherein the bottom surface is flat.

* * * * *